US009644792B2

(12) United States Patent
Moszkowski et al.

(10) Patent No.: US 9,644,792 B2
(45) Date of Patent: May 9, 2017

(54) METHOD OF FULLY EXPELLING COMPRESSED GAS FROM A TANK

(71) Applicants: Marc Moszkowski, Pensacola, FL (US); Benton Frederick Baugh, Houston, TX (US)

(72) Inventors: Marc Moszkowski, Pensacola, FL (US); Benton Frederick Baugh, Houston, TX (US)

( * ) Notice: Subject to any disclaimer, the term of this patent is extended or adjusted under 35 U.S.C. 154(b) by 21 days.

(21) Appl. No.: 14/729,160

(22) Filed: Jun. 3, 2015

(65) Prior Publication Data

US 2016/0356422 A1 Dec. 8, 2016

(51) Int. Cl.
*B65B 31/00* (2006.01)
*F17C 5/06* (2006.01)

(52) U.S. Cl.
CPC ..... *F17C 5/06* (2013.01); *F17C 2205/0323* (2013.01); *F17C 2205/0364* (2013.01); *F17C 2223/0123* (2013.01); *F17C 2223/036* (2013.01); *F17C 2225/0123* (2013.01); *F17C 2225/036* (2013.01); *F17C 2227/041* (2013.01); *F17C 2260/02* (2013.01); *F17C 2270/0105* (2013.01); *F17C 2270/0171* (2013.01)

(58) Field of Classification Search
CPC ..... F17C 5/06; F17C 2223/0123; F17C 2225/036; F17C 2225/0123; F17C 2205/0364; F17C 2270/0105; F17C 2260/02; F17C 2227/04; F17C 2227/041; F17C 2227/042
See application file for complete search history.

(56) References Cited

U.S. PATENT DOCUMENTS 2,854,826 A * 10/1958 Johnston ..... F04B 15/08 137/210

OTHER PUBLICATIONS

U.S. Appl. No. 12/804,259, filed Jan. 19, 2012, M. Moszkowski.

* cited by examiner

*Primary Examiner* — Jason K Niesz

(57) ABSTRACT

The method of transferring compressed gas at from a first tank to a second tank without decompressing the compressed gas and then re-pressuring the compressed gas comprising filling the second tank with a fluid, connecting a first fluid connection on the first tank to a second fluid connection on the second tank with a first line with one or more first valves, connecting a first gas connection on the first tank to a second gas connection on the second tank with a second line with one or more second valves, opening the first valves and the second valves to allow the compressed gas to pressurize the fluid, and pumping the fluid in the second tank into the first tank, thereby causing the compressed gas in the first tank to be displaced into the second tank.

34 Claims, 8 Drawing Sheets

METHOD OF FULLY EXPELLING COMPRESSED GAS FROM A TANK

TECHNICAL FIELD

This invention relates to the method expelling compressed gas from one or more compressed gas tanks, especially as associated with the transportation and delivery of compressed natural gas.

BACKGROUND OF THE INVENTION

The transportation of natural gas from the supply location to the tanks at the market by ship or truck transportation tanks requires that the gas be highly compressed to make the transportation economic. The expense of high pressure transportation tanks (e.g. 3000 p.s.i.) rather than at atmospheric pressure (e.g. 0 p.s.i.) is more than offset by the fact that about 250 times as much gas product can be transported.

A second problem exists that if the tanks at the market have an intermediate pressure such as 600 p.s.i. When the 3000 p.s.i. high pressure transportation tanks are dumped into the market tanks, approximately 1780 p.s.i. will remain in the transportation tanks. This means that approximately 60% of the product transported remains undelivered.

Two choices have remained here in the art. First, you can simply leave the gas in the transportation tanks for the return trip and always be transporting this 60% of the volume back and forth from the supply location to the market location. Secondly you can provide gas compression pumps to pump the stranded gas from the ship or truck transportation tanks and deliver all the gas to market. The gas compressors are expensive and expensive to operate. However, the higher cost in many cases is the time tying up the access to the terminal while they are being pumped out. Especially in the case of ocean going ship terminals, the dock time is an expensive charge. However, because of the efficiency of the compressors, residual pressure never comes below about 600 p.s.i. or 20% of the original pressure.

Throughout the history of the transportation of natural gas, the balance between the transportation of the stranded gas in the transportation tanks and the cost to pump it out has been studied with various combinations of stranded gas and compression applied. In the case of trucks, the total volume of stranded gas is not large, however, in very large ocean going vessels, the amount of gas stranded by contemporary methods can be very large.

Another problem associated with conventional methods of transportation are nefarious thermal issues. If the receiving tank pressure is zero and the transportation tank pressure is 3,000 p.s.i., for example, the instantaneous temperature drop upon opening the valve would be 84 degrees K or 151 degrees F., with very bad consequences if there was any water or foreign gases or liquids in the transportation tank. In addition to substantial thermal risks, the 3000 p.s.i. on the transportation tank and 0 p.s.i. in the receiving tank will average out to be 1500 p.s.i. in both tanks, with half of the gas being delivered. At that point gas compressors would be employed with more and more time and money spent as the percentage of the transported gas is transferred, as was also indicated above.

BRIEF SUMMARY OF THE INVENTION

The object of this invention is to provide a method of transferring compressed gas from a transportation tank to a stationary tank with little or no gas in it and vice-versa without requiring the use of gas compressors.

A second objective of this invention to provide a method of transferring compressed gas from a transportation tank to a stationary tank with little or no gas in it and vice-versa without decompression and recompression.

A third objective of this invention is that all of the gas is expelled from the transportation tank so that all the product is delivered to market, rather than a lower pressure residual simply being carried back in the transportation tank for another trip.

Another objective of this invention is that as the tank can be totally purged, it can also be disconnected from the other tanks for maintenance, if required, which would be precluded by any residual natural gas in the tanks.

Another advantage of this invention is that the connectors can easily be backfilled with either a liquid or nitrogen before being safely disconnected.

Another objective of this invention is that there is no transfer of liquid between the two systems, the required power to pump the water would be 5,600 kW with an expenditure of 5.5 metric tons of gas. Gas usage would not really be a problem but power would, as well as regulation of the system.

Another objective of this invention is minimizing the transfer differential pressure so that it enables the installation of safety devices on the tanks so that in case of a collision when the piping on top of the tanks is ripped off or any other type of leakage, a safety mechanism can quickly shut down the flow of gas trying to exit the tank through the broken piping, substantially increasing the safety level of the system.

DETAILED DESCRIPTION OF THE INVENTION

Figure 1:
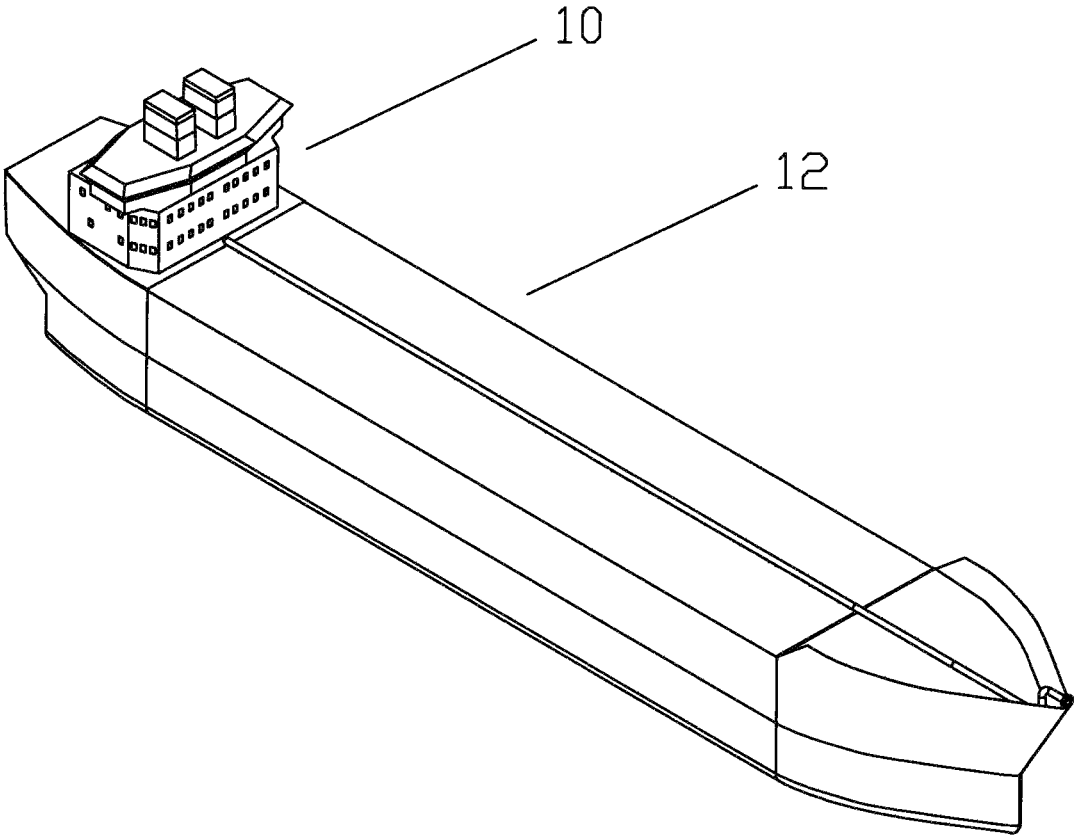
FIG. 1 is a view of a vessel having the filling method of this invention.

Referring now to FIG. 1, an offshore tanker 10 is shown which has a substantial central portion 12 which contains gas storage tanks.

Figure 2:
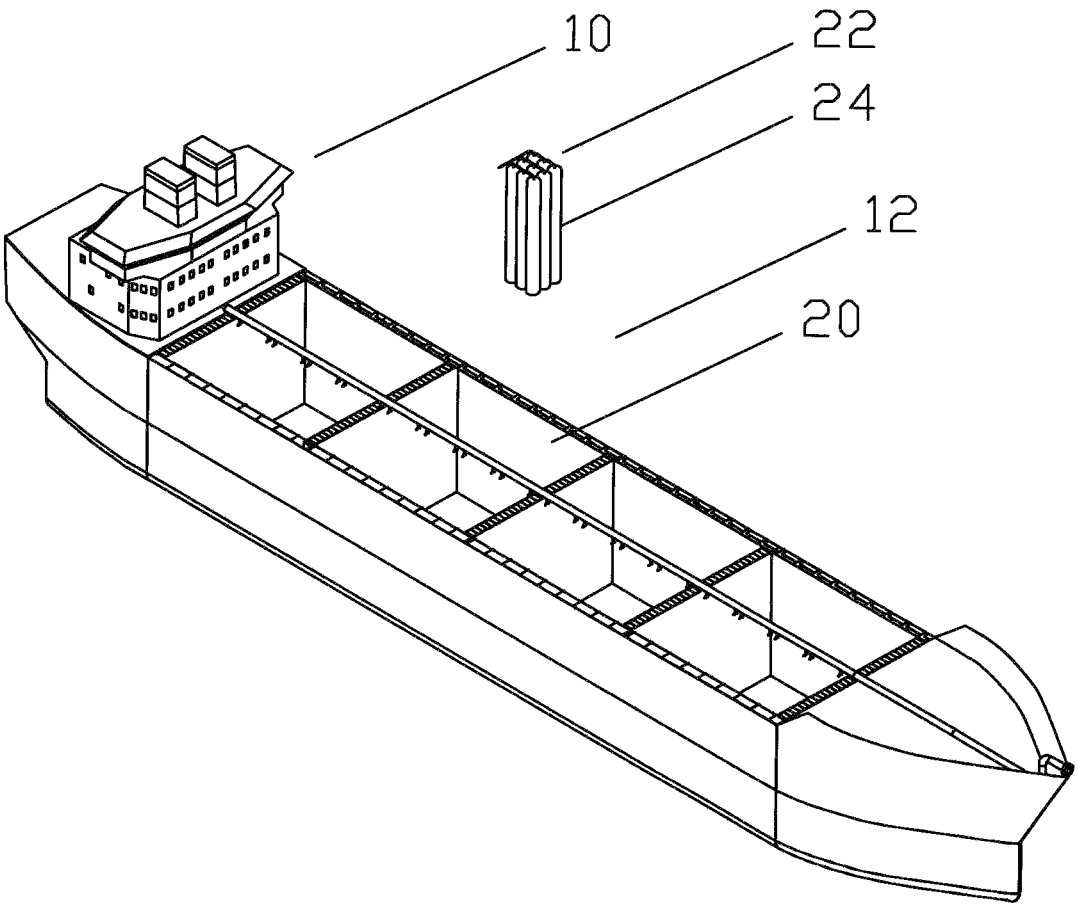
FIG. 2 is a view of the vessel of FIG. 1 with the top deck removed and showing a set of tanks about to be installed.

Now referring to FIG. 2, the offshore tanker 10 is shown with the top cover from the central portion 12 removed and showing a number of storage chambers 20. A bank of storage bottles 22 is shown with one of the individual bottles identified as 24. Individual bottles can be of a variety of sizes, for example 24 inches in diameter by 45 feet long.

Figure 3:
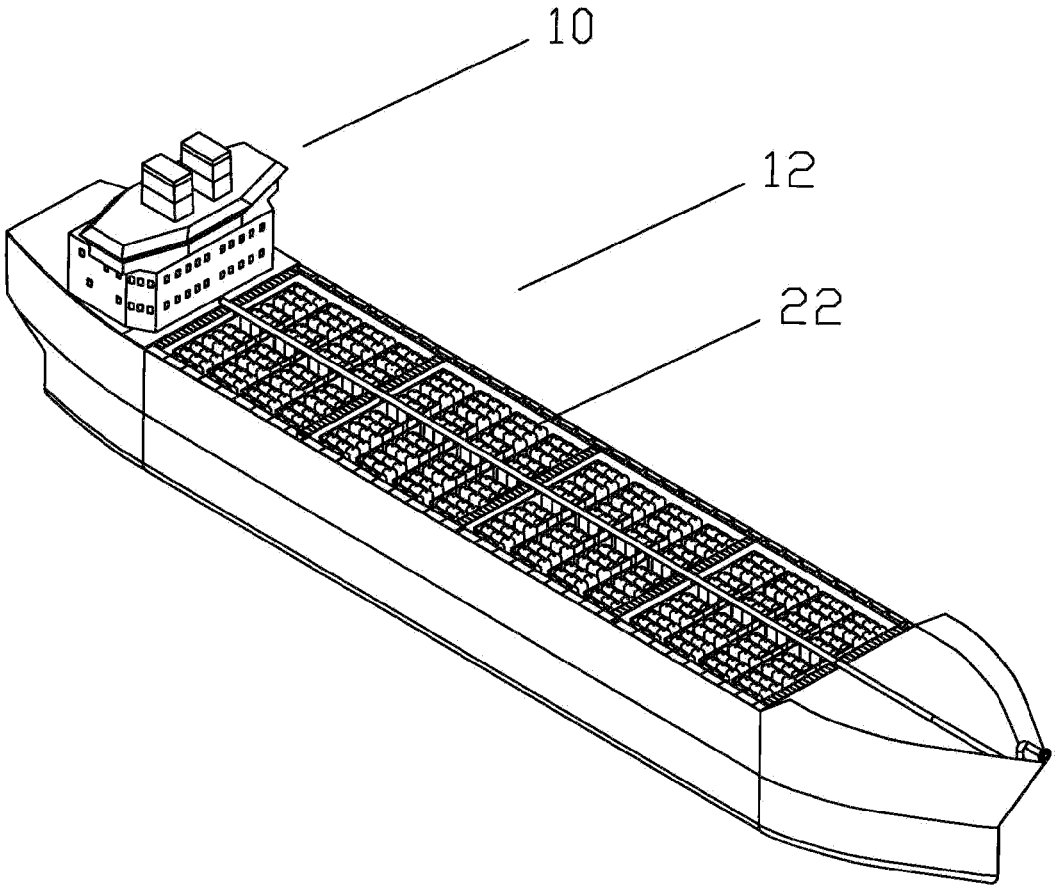
FIG. 3 is a view of the vessel of FIG. 2 with a full complement of storage bottles installed.

Referring now to FIG. 3, offshore tanker 10 is shown with more of the double wall covering from central portion 12 removed and a full set of bottles 22 installed. In this model 576 of the bottles 24 are shown.

Figure 4:
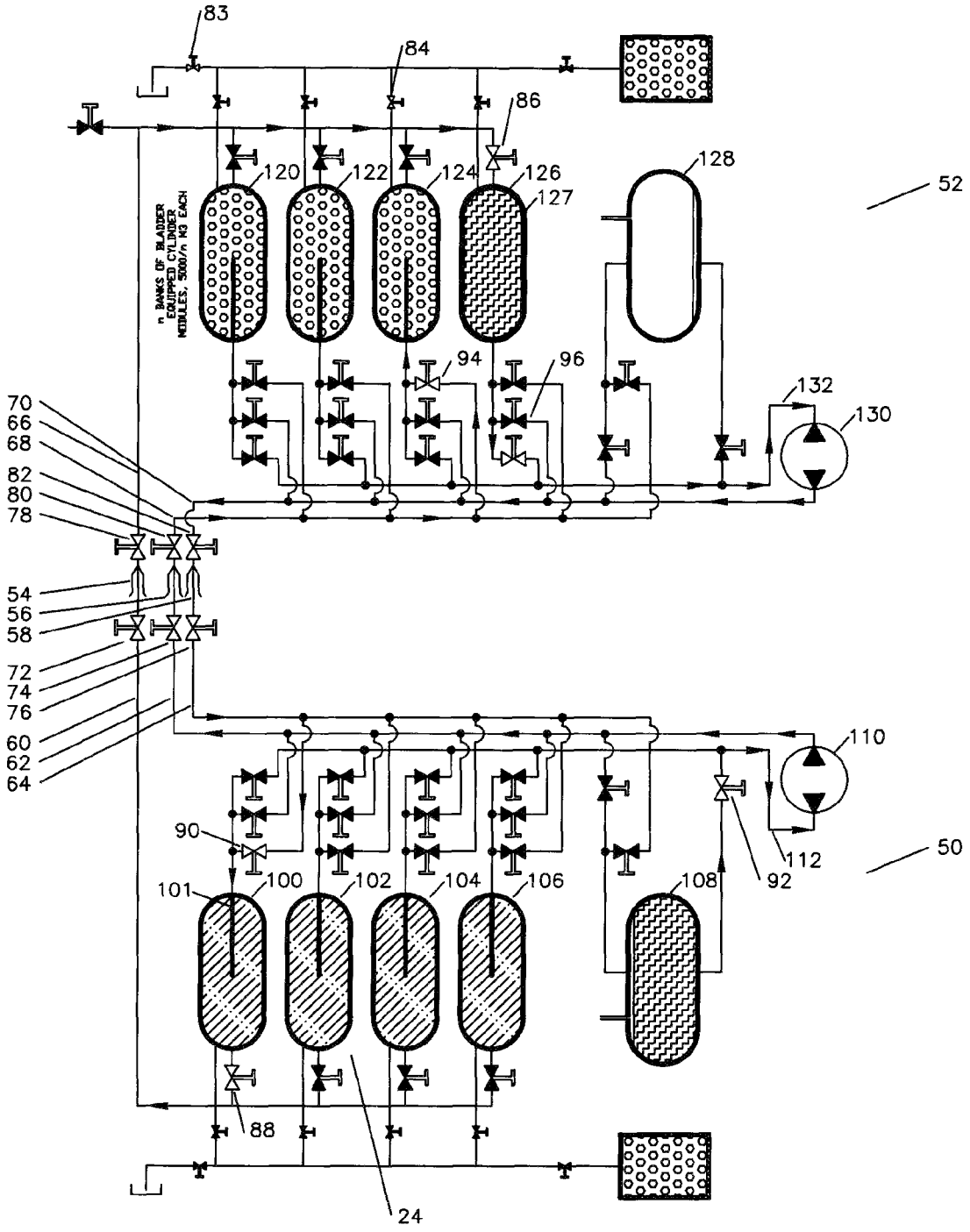
FIG. 4 is a schematic of method of the present invention as would be seen when the transportation vessel arrives at the delivery location, valves are opened, but pumping has not started.

Referring now to FIG. 4, a graphic of the pumping system of this invention is shown. The lower portion of the graphic shows a transportation tank system 50 for transportation of the compressed gases and the upper portion shows a stationary tank system 52. The transportation tank system 50 will likely be aboard a ship, but can be transported by a variety of means including barges, railroads, and trucks. The stationary tank system 52 is described following as the location to which the transportation tank system 50 delivers the compressed natural gas for distribution and use but can as well represent the location where the transportation tank system is efficiently loaded, whether from a shore based or offshore location.

Hose connectors 54, 56, and 58 connect hoses 60, 62, and 64 from the transportation tank system to piping 66, 68, and 70 on the stationary tank system. The connectors 54, 56, and 58 can be one of several styles which are well known in the art. Due to size they will likely be of the remotely hydraulically operated type. Valves 72, 74, and 76 and valves 78, 80, and 82 are on each side of hose connectors 54, 56, and 58 to close off the ends of the hoses or piping when a disconnection is done. Hoses 60, 62, and 64 can be neutrally buoyant with additional buoyancy added to float the valves 72, 74, and 76 also as they move to the shore installation for connection. Alternately the piping 66, 68, and 70 can be floating hoses, or both sides of the hose connectors 54, 56, and 58 can be floating hoses.

The floating gas hose would be rated for a working pressure of 4,250 p.s.i. (we plan to work at 2,133 p.s.i.), inside diameter 7 inch, outside diameter 11 inch, minimum dynamic bending radius 9 foot (7 foot static and 6 foot storage), weight 68 lbs. per ft. The liquid hoses would be the same, which enjoys a higher rating of 5,000 p.s.i. There would be 1 gas line and two liquid lines. The 3 hoses will be bundled, except at their end. Fluid flow needs to be 1,000 cubic meters per hour (4,400 GPM), but with little head if the fluid flows between the receiving and the loading station. The system is inherently safe as no pressure control needs to be applied. In some cases, the difficulty of handling the large high pressure hoses may be made more practical by handling them with a crane.

When a fully loaded transportation tank system comes into port for unloading, all valves in both the transportation tank system and the stationary tank system will be closed. After the hose connectors 54, 56, and 58 are connected, valves 72, 74, and 76 and valves 78, 80, and 82 are opened as shown. Additionally, valves 86, 88, 90, 92, 94, and 96 are opened.

Tank 100 shows bladder 101 which is empty and collapsed to a flat position. Tank 126 shown bladder 127 which is fully expanded against the internal walls of tank 126. The bladders are resilient balloon like members which separate the fluids and gases which will be in the tanks from time to time. Various means can be utilized to achieve this separation of fluids and gases such as floating piston. In some cases no separating method would be required if the fluid utilized did not tend to absorb the gasses and floats or sonar was used to monitor the level of the fluids in the tanks.

All valves in this description are shown as manual valves for simplicity. For rapid and controlled operations, all valves are likely to be remotely controlled.

By opening valves 86 and 88 the pressure of the gas in tank 100 will pressurize the fluid in tank 126. Operating pump 130 will draw fluid out the bladder of tank 126 and pump it through hoses 132, 70 and 64 and valve 90 to tank 100. This will displace the compressed natural gas in tank 100 through valve 88 hoses 60 and 66, through valve 86 and into the space outside the bladder in tank 126. As the pressure in the two tanks was equalized, there will not be a head pressure to pump against, but rather simply flowing friction losses will be incurred.

When pump 110 is operated, fluid will be drawn from tank 108 through valve 92 and pumped through hoses 62 and 68 into the bladder of tank 124. The nitrogen gas in tank 124 will be vented through valves 84 and 83. As the fluid in tank 108 and the nitrogen gas in tank 124 are at atmospheric pressure, there will not be a head pressure to pump against, but rather a simple flowing friction loss will be incurred.

This means that the pressure of tanks 100 and 126 will be the same, and will remain the same during the entire gas transfer process at the high pressure of the compressed natural gas. The pressure in tanks 108 and 124 will be a relatively constant pressure at atmospheric pressure plus a small pumping flow loss. This means safety relief valves can be installed on closely controlled conditions rather than trying to compromise on varying pressures of a typical compression process. The ability this provides to quickly recognize a leakage condition or overpressure condition can substantially increase the safety of the systems.

Figure 5:
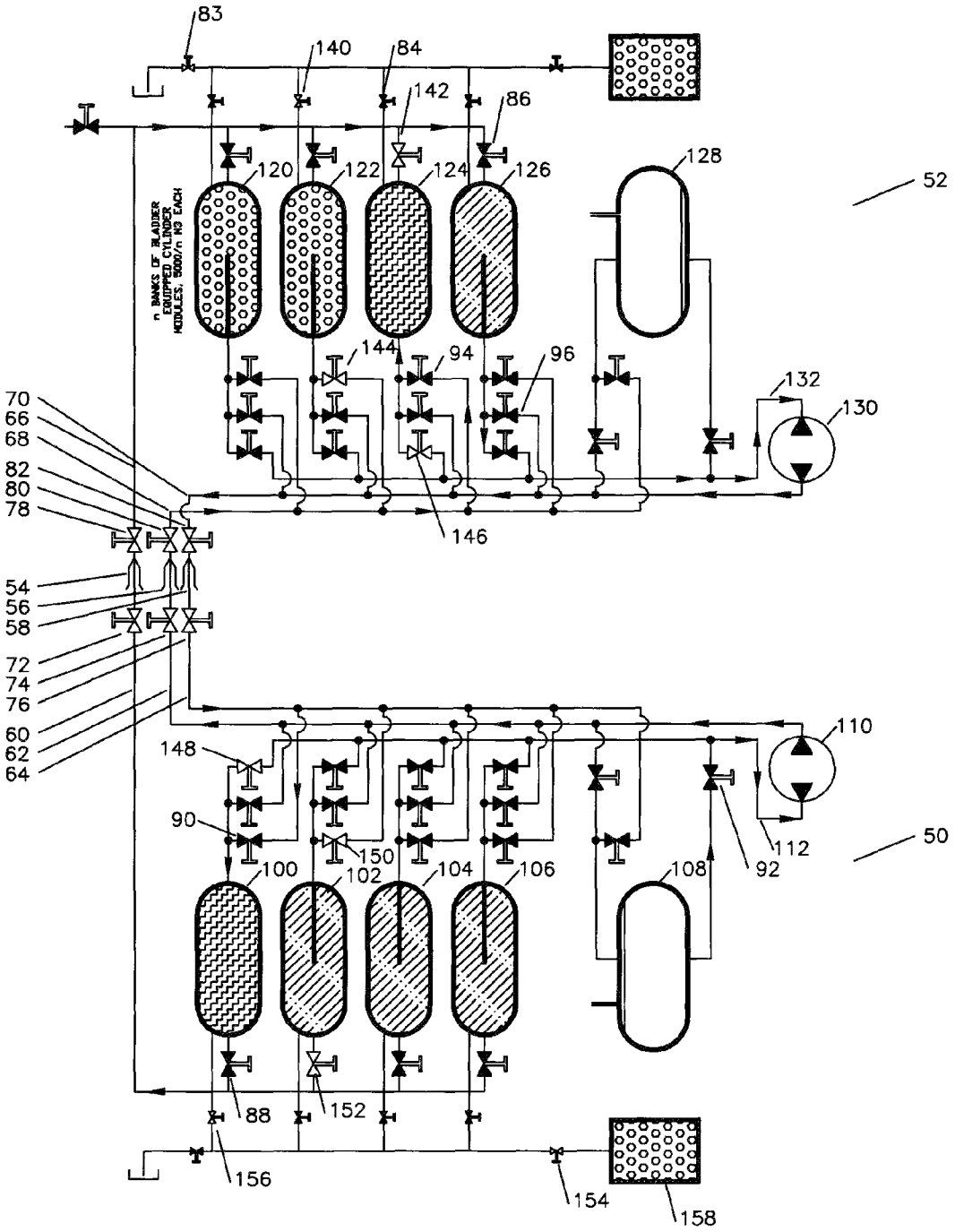
FIG. 5 is a schematic of method of the present invention after a first tank of compressed natural gas has been transferred and valves are set up to deliver the second tank of compressed natural gas.

Referring now to FIG. 5, the results of the pumping in FIG. 4 is seen. Valves 84, 86, 88, 90, 92, 94, and 96 are now closed. Valves 140, 142, 144, 146, 148, 150, 152, 154, and 156 are opened.

Operating pump 130 will draw fluid out the bladder of tank 124 and pump it through valve 146, hoses 132, 70 and 64, valve 150 and into the bladder of tank 102. This will displace the compressed natural gas in tank 102 through valve 152, hoses 60 and 66, valve 142 and into the space outside the bladder in tank 124.

When pump 110 is operated, fluid will be drawn from tank 100 through valve 148, hoses 112, 62 and 68, valve 144 and into the bladder of tank 122.

The nitrogen gas in tank 122 will be vented through valves 140 and 83. Nitrogen plant 158 will generate nitrogen and pump it through valves 154 and 156 into the area outside the bladder in tank 100.

Figure 6:
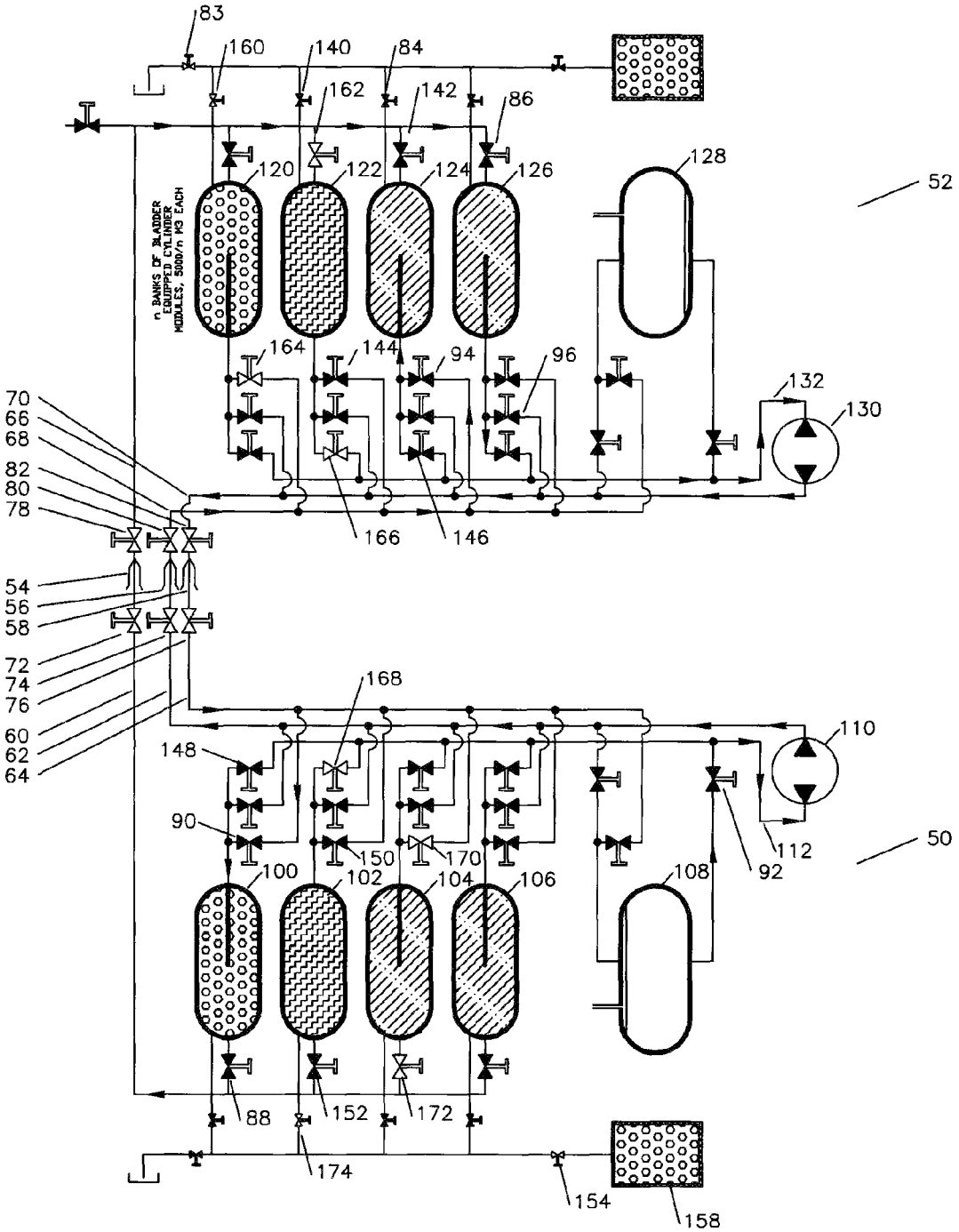
FIG. 6 is a schematic of method of the present invention after the second tank of compressed natural gas has been transferred and valves are set up to deliver the third tank of compressed natural gas

Referring now to FIG. 6, the results off the pumping in FIG. 5 is seen. Valves 140, 142, 144, 146, 148, 150, and 152 are now closed. Valves 160, 162, 164, 166, 168, 170, 172, and 174 are opened.

Operating pump 130 will draw fluid out the bladder of tank 122 and pump it through valve 164, hoses 132, 70 and 64, valve 170 and into the bladder of tank 104. This will displace the compressed natural gas in tank 104 through valve 172, hoses 60 and 66, valve 164 and into the space outside the bladder in tank 122.

When pump 110 is operated, fluid will be drawn from tank 102 through valve 168, hoses 62 and 68, valve 164 and into the bladder of tank 120.

The nitrogen gas in tank 120 will be vented through valves 160 and 83. Nitrogen plant 158 will generate nitrogen and pump it through valves 154 and 174 into the area outside the bladder in tank 102.

Figure 7:
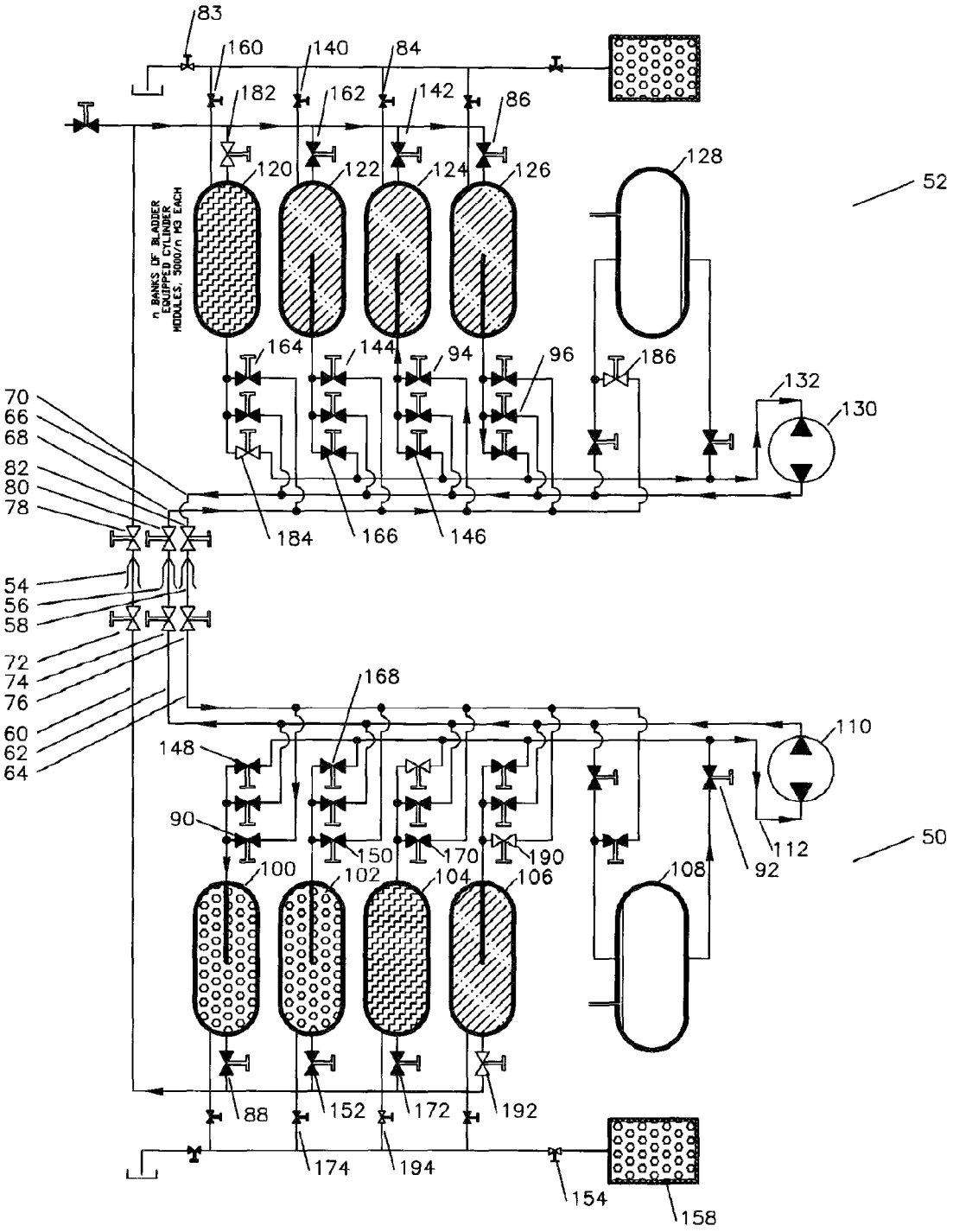
FIG. 7 is a schematic of method of the present invention after the third tank of compressed natural gas has been transferred and valves are set up to deliver the fourth tank of compressed natural gas.

Referring now to FIG. 7, the results off the pumping in FIG. 6 is seen. Valves 160, 162, 164, 166, 168, 170, and 172 are now closed. Valves 182, 184, 186, 188, 190, 192 and 194 are opened.

Operating pump 130 will draw fluid out the bladder of tank 120 and pump it through valve 184, hoses 132, 70 and 64, valve 190 and into the bladder of tank 106. This will displace the compressed natural gas in tank 106 through valve 192, hoses 60 and 66, valve 182 and into the space outside the bladder in tank 120.

When pump 110 is operated, fluid will be drawn from tank 104 through valve 188, hoses 112, 62 and 68, valve 186 and into tank 128.

Nitrogen plant 158 will generate nitrogen and pump it through valves 154 and 194 into the area outside the bladder in tank 104.

Figure 8:
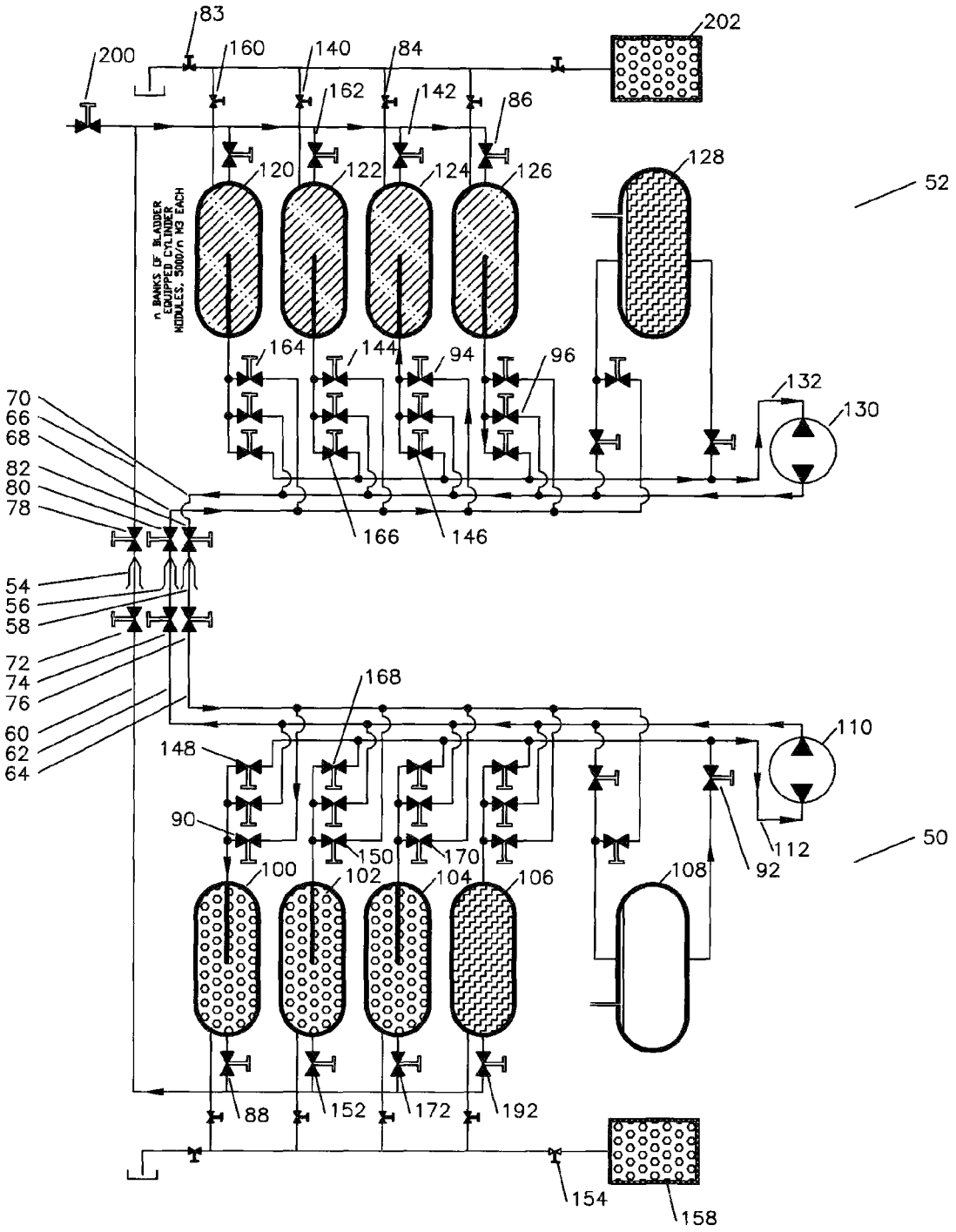
FIG. 8 is a schematic of method of method of the present invention after the fourth tank of compressed natural gas has been transferred and all valves are closed.

Referring now to FIG. 8, as the compressed natural gas in tanks 120, 122, 124, and 126 are exported to users through valve 200, nitrogen from nitrogen plant 202 will be pumped into the space outside the bladders of tanks 120, 122, and 124 and fluids are pumped from tank 128 into the bladder of tank 126 to be prepared for a subsequent reloading.

As the transportation tank system 50 is in transit to the supply location, the fluids in the bladder of tank 106 are pumped into tank 108 and nitrogen from nitrogen plant 158 is pumped into the space outside the bladder of tank 106. These final pumping operations will return the status of the transportation tank system 50 and the stationary tank system to the status as was shown in FIG. 4.

Another advantage of this invention is minimizing of the transfer differential pressure is that it enables the installation of safety devices on the tanks. In case of a collision when the piping on top of the tanks is ripped off, a valve mechanism shuts down the flow of gas trying to exit the tank through the broken piping, activated by the differential pressure above a certain predetermined level.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

That which is claimed is:

1. The method of transferring compressed gas at from a set of delivery tanks to a set of receiving tanks without decompressing said compressed gas and then re-pressuring said compressed gas comprising:

a first step of connecting a first fluid delivery connection on a first delivery tank of said set of delivery tanks to a first receiving fluid connection on a first receiving tank of said set of receiving tanks with a first fluid line with one or more first fluid valves, said first delivery tank containing first fluid and said first receiving tank not containing a fluid, opening said first valves and pumping said first fluid from said first delivery tank into said first receiving tank, a second step of providing a second compressed gas filled tank associated with said delivery tanks and a second fluid filled tank associated with said receiving tanks, connecting a second fluid delivery connection on a second delivery tank of said set of delivery tanks to a second receiving fluid connection on a second receiving tank of said set of receiving tanks with a second fluid line with one or more second fluid valves, connecting a first gas delivery connection on said second delivery tank of said set of delivery tanks to a second gas receiving connection on said second receiving tank on said set of receiving tanks with a second line with one or more second gas valves, said second delivery tank containing a first compressed gas and said second receiving tank containing a second fluid, opening said second fluid valves to allow said first compressed gas to pressurize said second fluid, opening said first gas valves and pumping said second fluid from said second receiving tank into said second delivery tank such that said first compressed gas will be displaced into said second receiving tank, and repeating said first step and said second step with a third delivery tank filled with a second compressed gas taking the place of said second delivery tank, said first receiving tank taking the place of said second receiving tank for the exchange of a second fluid with a second gas, and said first delivery tank being replaced by said second delivery tank and a third receiving tank taking the place of said first receiving tank for transferring a second fluid from said delivery set of tanks to said receiving set of tanks.

2. The invention of claim 1 further comprising said set of tanks is on a moving vessel for transportation.

3. The invention of claim 2 further comprising said fluid in said moving vessel is a ship.

4. The invention of claim 2 further comprising said fluid in said moving vessel is a barge.

5. The invention of claim 2 further comprising said fluid in said moving vessel is a train.

6. The invention of claim 2 further comprising said fluid in said moving vessel is a truck.

7. The invention of claim 1 further comprising said set of tanks is on a moving vessel for transportation.

8. The invention of claim 7 further comprising said fluid in said moving vessel is a ship.

9. The invention of claim 7 further comprising said fluid in said moving vessel is a barge.

10. The invention of claim 7 further comprising said fluid in said moving vessel is a train.

11. The invention of claim 7 further comprising said fluid in said moving vessel is a truck.

12. The invention of claim 1 further comprising said first line and said second line have connectors intermediate their ends.

13. The invention of claim 12 further comprising said first line and said second line are neutrally buoyant for floating in seawater for connection.

14. The invention of claim 12 further comprising said first line and said second line can be flooded with an environmentally friendly fluid or gas prior to disconnection.

15. The method of transferring compressed gas at a first pressure and first temperature environmental conditions from a first tank to a second tank without decompressing said compressed gas and then re-pressuring said compressed gas comprising:

said compressed as being above its boiling temperature in said environmental conditions within said tanks, filling said second tank with a fluid, said fluid being below its boiling temperature in said environmental conditions, connecting a first fluid connection on said first tank to a second fluid connection on said second tank with a first line with one or more first valves, connecting a first gas connection on said first tank to a second gas connection on said second tank with a second line with one or more second valves, opening said first valves and said second valves to allow said compressed gas to pressurize said fluid, and pumping said fluid in said second tank into said first tank, thereby causing said compressed gas in said first tank to be displaced into said second tank.

16. The invention of claim 15 further comprising said first tank is on a moving vessel for transportation.

17. The invention of claim 16 further comprising said fluid in said moving vessel is a ship.

18. The invention of claim 16 further comprising said fluid in said moving vessel is a barge.

19. The invention of claim 16 further comprising said fluid in said moving vessel is a train.

20. The invention of claim 16 further comprising said fluid in said moving vessel is a truck.

21. The invention of claim 15 further comprising said second tank is on a moving vessel for transportation.

22. The invention of claim 21 further comprising said fluid in said moving vessel is a ship.

23. The invention of claim 21 further comprising said fluid in said moving vessel is a barge.

24. The invention of claim 21 further comprising said fluid in said moving vessel is a train.

25. The invention of claim 21 further comprising said fluid in said moving vessel is a truck.

26. The method of transferring compressed gas at from a first tank to a second tank without decompressing said compressed gas and then re-pressuring said compressed gas comprising:

filling said second tank with a fluid, connecting a first fluid connection on said first tank to a second fluid connection on said second tank with a first line with one or more first valves, connecting a first gas connection on said first tank to a second gas connection on said second tank with a second line with one or more second valves, opening said first valves and said second valves to allow said compressed gas pressurize said fluid, pumping said fluid in said second tank into said first tank, thereby causing said compressed gas in said first tank to be displaced into said second tank, and said first fluid connection is separated from said first gas connection in said first tank by a bladder.

27. The method of transferring compressed gas at from a first tank to a second tank without decompressing said compressed gas and then re-pressuring said compressed gas comprising:

filling said second tank with a fluid, connecting a first fluid connection on said first tank to a second fluid connection on said second tank with a first line with one or more first valves, connecting a first gas connection on said first tank to a second gas connection on said second tank with a second line with one or more second valves, opening said first valves and said second valves to allow said compressed gas to pressurize said fluid, pumping said fluid in said second tank into said first tank, thereby causing said compressed gas in said first tank to be displaced into said second tank, and said first fluid connection is separated from said first gas connection in said first tank by a piston.

28. The method of transferring compressed gas at from a first tank to a second tank without decompressing said compressed gas and then re-pressuring said compressed gas comprising:

filling said second tank with a fluid, connecting a first fluid connection on said first tank to a second fluid connection on said second tank with a first line with one or more first valves, connecting a first gas connection on said first tank to a second gas connection on said second tank with a second line with one or more second valves, opening said first valves and said second valves to allow said compressed gas to pressurize said fluid, pumping said fluid in said second tank into said first tank, thereby causing said compressed gas in said first tank to be displaced into said second tank, and said second fluid connection is separated from said second gas connection in said second tank by a bladder.

29. The method of transferring compressed gas at from a first tank to a second tank without decompressing said compressed gas and then re-pressuring said compressed gas comprising:

filling said second tank with a fluid, connecting a first fluid connection on said first tank to a second fluid connection on said second tank with a first line with one or more first valves, connecting a first gas connection on said first tank to a second gas connection on said second tank with a second line with one or more second valves, opening said first valves and said second valves to allow said compressed gas to pressurize said fluid, pumping said fluid in said second tank into said first tank, thereby causing said compressed gas in said first tank to be displaced into said second tank, and said second fluid connection is separated from said second gas connection in said second tank by a piston.

30. The invention of claim 15 further comprising said fluid is water.

31. The invention of claim 15 further comprising said fluid contains an additive to reduce the freezing temperature.

32. The method of transferring compressed gas at from a first tank to a second tank without decompressing said compressed gas and then re-pressuring said compressed gas comprising:

filling said second tank with a fluid, connecting a first fluid connection on said first tank to a second fluid connection on said second tank with a first line with one or more first valves, connecting a first gas connection on said first tank to a second gas connection on said second tank with a second line with one or more second valves, opening said first valves and said second valves to allow said compressed gas to pressurize said fluid, pumping said fluid in said second tank into said first tank, thereby causing said compressed gas in said first tank to be displaced into said second tank, and said first line and said second line have connectors intermediate their ends.

33. The invention of claim 32 further comprising said first line and said second line are neutrally buoyant for floating in seawater for connection.

34. The invention of claim 32 further comprising said first line and said second line can be flooded with an environmentally friendly fluid or gas prior to disconnection.

* * * * *